US006655522B2

(12) United States Patent
Thudium et al.

(10) Patent No.: US 6,655,522 B2
(45) Date of Patent: Dec. 2, 2003

(54) TRANSFER PRESS AND APPARATUS FOR LOADING AND UNLOADING WORKPIECES

(75) Inventors: Karl Thudium, Waeschenbeuren (DE); Andreas Lauke, Gruibingen (DE)

(73) Assignee: Schuler Pressen GmbH & Co. KG, Goeppingen (DE)

( * ) Notice: Subject to any disclaimer, the term of this patent is extended or adjusted under 35 U.S.C. 154(b) by 0 days.

(21) Appl. No.: 09/922,916

(22) Filed: Aug. 7, 2001

(65) Prior Publication Data

US 2002/0023820 A1 Feb. 28, 2002

(30) Foreign Application Priority Data

Aug. 10, 2000 (DE) ..... 100 39 062

(51) Int. Cl.[7] ..... B65G 37/00

(52) U.S. Cl. ..... 198/346.2; 198/468.2; 198/468.4; 198/468.6; 198/750.11; 198/750.12

(58) Field of Search ..... 198/346.2, 468.2, 198/468.4, 468.5, 468.6, 750.11, 750.12, 750.13, 750.14; 414/222.07, 225.01, 226.01, 226.02, 751.1, 752.1, 753.1

(56) References Cited

U.S. PATENT DOCUMENTS

| | | | | | |
|---|---|---|---|---|---|
| 4,386,693 | A | * | 6/1983 | Bachman | 198/468.2 |
| 4,419,039 | A | * | 12/1983 | Bengtsson | 414/225.01 |
| 4,693,361 | A | | 9/1987 | Baba | |
| 4,971,515 | A | * | 11/1990 | Pol et al. | 414/752.1 |
| 5,452,981 | A | * | 9/1995 | Crorey et al. | 198/468.6 |
| 6,055,895 | A | * | 5/2000 | Kanazawa | 414/752.1 |
| 6,179,547 | B1 | * | 1/2001 | Hayakawa | 198/468.4 |
| 6,253,907 | B1 | * | 7/2001 | Lachmann et al. | 198/750.14 |
| 6,264,419 | B1 | * | 7/2001 | Schinzel | 414/751.1 |

* cited by examiner

*Primary Examiner*—Joseph E. Valenza
(74) *Attorney, Agent, or Firm*—Crowell & Moring LLP

(57) ABSTRACT

An apparatus loads and unloads workpieces. The apparatus includes at least one essentially horizontally movable element, at least one essentially vertically movable element and at least one element for receiving workpieces. The horizontally movable element has at least one drive unit and has at least two belts communicating with the one or more drive units and the one or more elements for receiving the workpieces.

7 Claims, 6 Drawing Sheets

TRANSFER PRESS AND APPARATUS FOR LOADING AND UNLOADING WORKPIECES

BACKGROUND AND SUMMARY OF THE INVENTION

This application claims the priority of German application 100 39 062.5, filed Aug. 10, 2000, the disclosure of which is expressly incorporated by reference herein.

The present invention relates to a transfer press and to an apparatus for loading and unloading workpieces.

DE 3336082 discloses a transfer press and shows divided gripper rails with grippers on the replaceable gripper rail sections, which can be turned up about a horizontal pivoting axis perpendicularly to the longitudinal extension of the gripper rails. The known construction can be used only for short transfer movements and relatively small workpieces and is not suitable for moving larger workpieces over a greater distance.

SUMMARY OF THE INVENTION

An object of the present invention is to provide an apparatus that obviates the above drawbacks and transports parts, including larger workpieces, very safely and reliably.

This object has been attained with an apparatus for loading and unloading workpieces, which has at least one essentially horizontally movable element, at least one essentially vertically movable element and at least one element for receiving workpieces.

An advantageous further development of the present invention provides that the horizontally movable element comprises at least one drive unit that produces the horizontal component of the movement. Still more advantageous are two drive elements because this increases operational safety since, even if one drive element fails, the entire apparatus can still be safely operated.

Another advantageous further development of the present invention provides that the horizontally movable element has at least two belts that communicate, respectively, with a drive unit and with the element for receiving the workpieces. These two drive belts increase the operating safety of the entire apparatus because safe operation is possible even with only a single belt.

Another advantageous further development provides that each belt is equipped with a belt lock. This increases not only the ease of operation and maintenance but also the operating safety and reliability of the apparatus.

An advantageous further development of the present invention provides that the horizontally movable element has at least one tension roller per belt. The tension roller(s) ensure(s) optimum belt tensioning at all times, so that optimum drive and friction conditions are present at any time of operation, and the degree of safety and reliability is further enhanced.

Another advantageous further development provides that the belts are linked by a bridge that is capable of limited deflection. This type of coupling of the two belts increases the degree of operating and production safety because, even if one drive belt fails, the other belt can maintain the function of the entire apparatus. Tests have shown that such an impaired drive is still capable of providing about two-thirds of the original output.

Another advantageous further development of the invention provides that the horizontally movable element has at least one guide. This guide or guides make it possible to achieve a highly reproducible transport result to enhance transport reliability.

An advantageous further development of the present invention provides that the horizontally movable element has at least one buffer for preventing damage in the event of malfunction. These stop buffers are suitable to prevent damage to the apparatus in case the apparatus ever accidentally leaves its planned path.

Still another advantageous further development provides that the vertically movable element has a safety brake, a motor and/or a spindle and/or a guide. This affords the advantage of increased operating safety even in vertical operation of the apparatus which is achieved by the individual elements.

Another object of the present invention has also been achieved by a transfer press with the loading and unloading apparatus that transmits the transfer movement to the workpieces. The transfer press here comprises the above-described apparatus for loading and unloading. The apparatus is freely programmable along the two axes (the y- and x-axis).

BRIEF DESCRIPTION OF THE DRAWINGS

Other objects, advantages and novel features of the present invention will become apparent from the following detailed description of the invention when considered in conjunction with the accompanying drawings.

DETAILED DESCRIPTION OF THE PREFERRED EMBODIMENT

Figure 1:
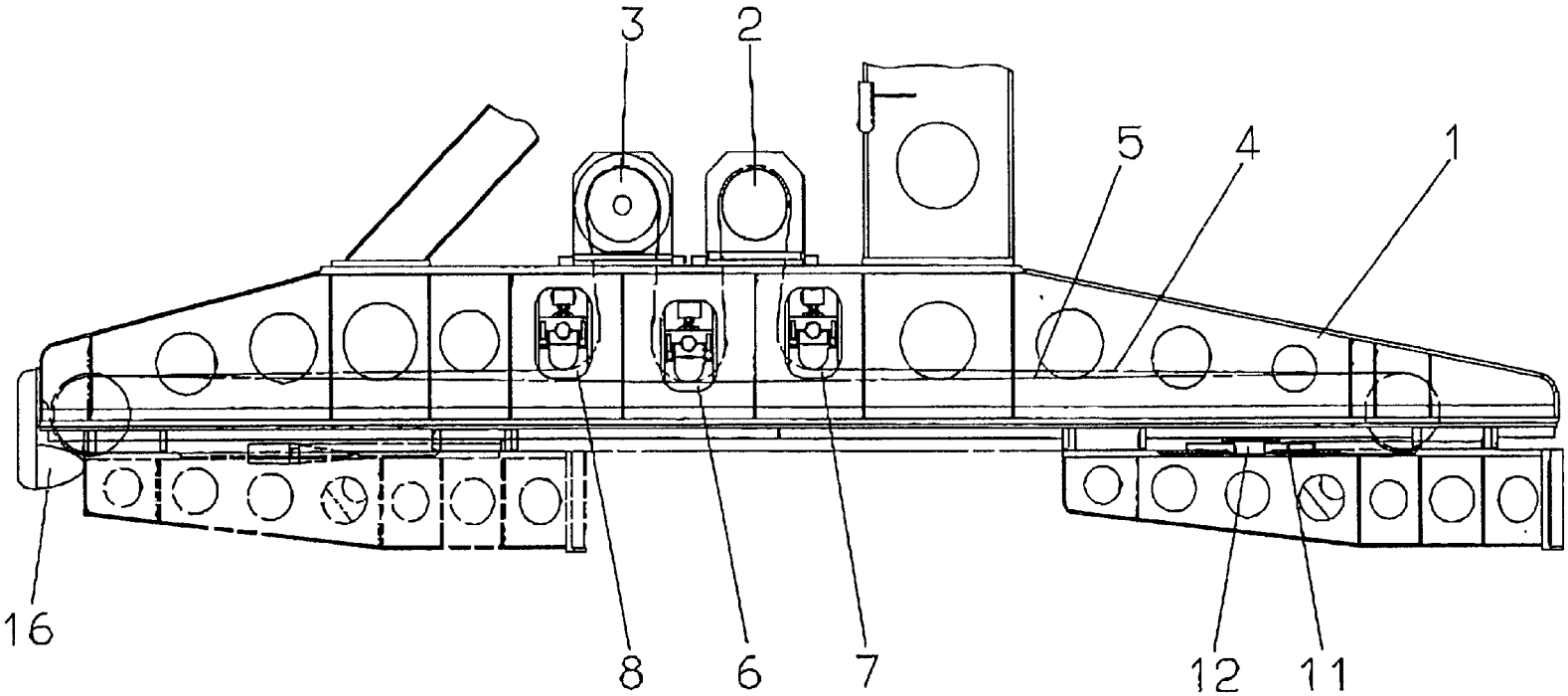
FIG. 1 is a view of the horizontal slide of the apparatus according to the present invention.

FIG. 1 shows the horizontal slide 1 of the workpiece loading and unloading apparatus. The horizontal slide 1 has a drive motor 2 for horizontal movement and a drive motor 3 for horizontal movement 3, which drive the horizontal slide 1 by way of belts 4, 5. The two belts 4, 5 run through the tension roller 6. The belt 4 also runs through tension roller 7, and the belt 5 also runs through tension roller 8. The purpose of all the tension rollers is to ensure optimal belt tension in all operating states of the apparatus.

A belt lock 11 and bridge 12 which is linked to the belt lock 11, are only outlined in FIG. 1. Buffers 16 are arranged at the rear of the horizontal conveyor 1 to prevent damage to the suction spider mount which is shown here in two positions (i.e., all the way to the back on the buffers 16 and all the way to the front).

Figure 2:
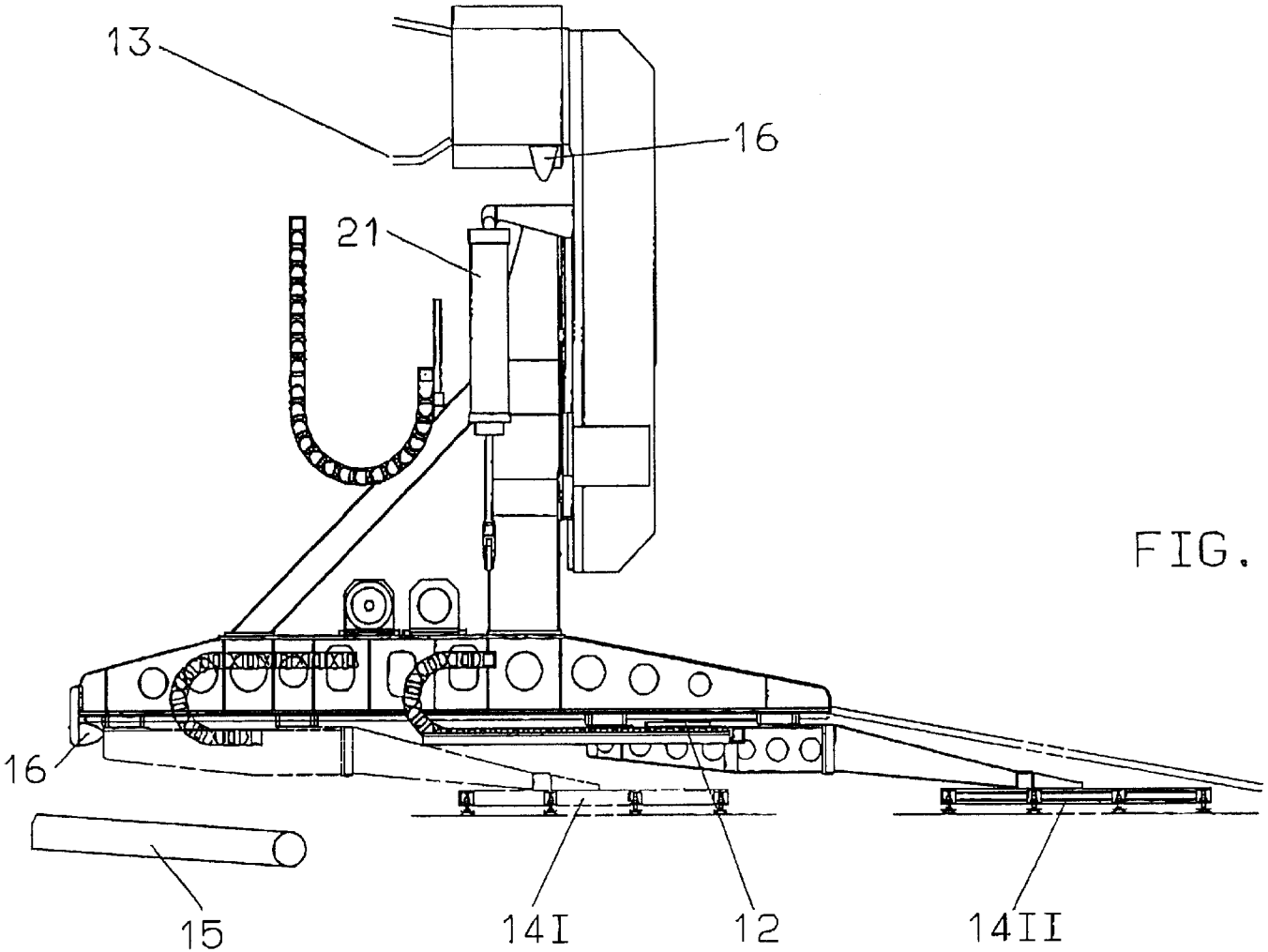
FIG. 2 is a side view of the height-adjustable loading device.

FIG. 2 shows the height adjustable loading device 13. The horizontal slide 1 is arranged underneath the loading device 13. To prevent damage, a buffer 16 is disposed on the loading device to prevent uncontrolled impact of the height adjustable portion of the loading device 13.

A suction spider 14 is arranged at the front end of the suction spider mount. In FIG. 2, the suction spider 14 can be seen in two operating positions 14 I (rear) and 14 II (front). A workpiece hanging from the suction spider 14 I is delivered by the feed conveyor 15 which is also a part of the transfer press so that the suction spider 14 can take the workpiece from the feed conveyor 15.

Figure 3:
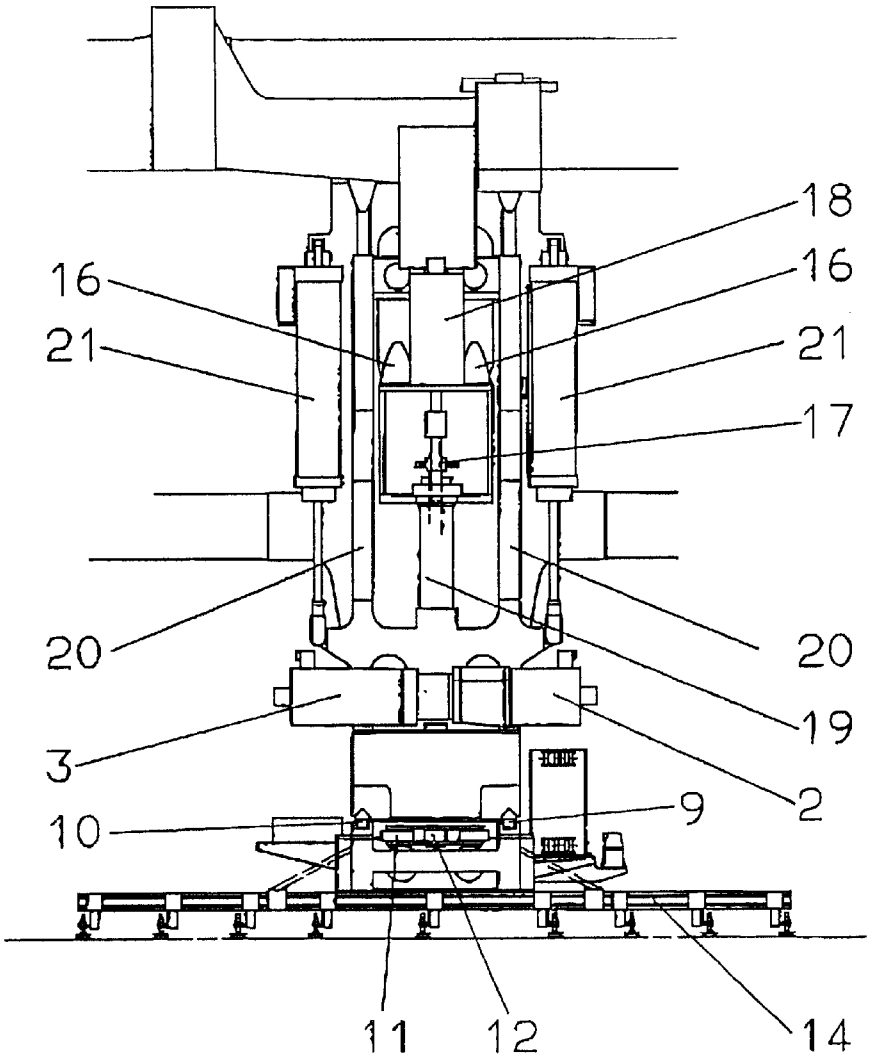
FIG. 3 is a front view of the height-adjustable loading device of FIG. 2.

FIG. 3 shows the front of the height-adjustable loading device 13. The horizontal slide 1 is arranged underneath the loading device 13. The buffer 16 disposed on the loading device prevents uncontrolled impact of the height adjustable portion of the loading device 13.

The two belts 4, 5 run through the tension roller for both belts 6 as shown in FIG. 1 but are not visible in FIG. 3. The belt lock 11 and the bridge 12 linked to the belt lock 11 are only outlined. Visible in FIG. 3 are the horizontal guides 9, 10 of the horizontal slide 1. The buffers 16 intended to prevent damage are arranged on the upper part of the loading device 13.

A suction spider 14 is arranged at the front end of the suction spider mount. A workpiece hanging from the suction spider 14 is delivered by the conveyor 15, which is not visible in FIG. 3 but which is also a part of the transfer press, so that the suction spider 14 can take the workpiece from the feed conveyor 15.

A safety brake 17 in this embodiment performs a locking function. A motor 18, which is responsible for the vertical component of the conveying process, is arranged above the safety brake 17 and the buffers 16 that act as shock absorbers in case of any malfunction. Other elements support this lifting and lowering process, such as a spindle 19 and a guide 20 as well as mechanical balance cylinders 21.

Figure 4:
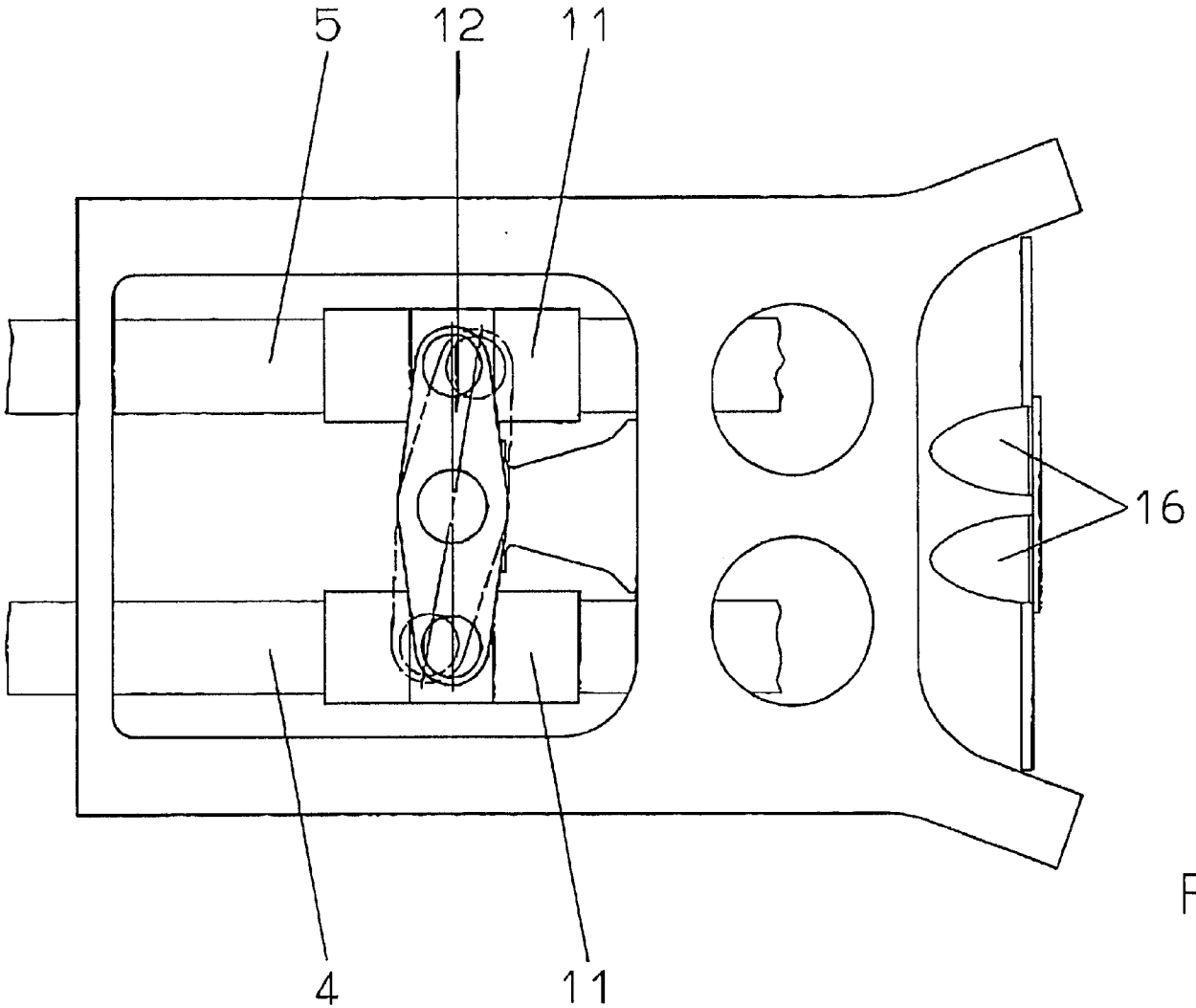
FIG. 4 is a view of a bridge with belt locks.

FIG. 4 shows the belts 4, 5 mounted to form a closed belt by way of belt lock 11. The two belts 4, 5 and the two belt locks 11, 11 are connected with one another via a bridge 12. The bridge 12 is capable to a limited extent of compensating relative shifts with respect to the belt movements. In an extreme case, if a belt breaks, the horizontal conveyor 1 continues to demonstrate its reliability with the assistance of the bridge 12. FIG. 4 shows two positions—(the operating position and the emergency position). At the rear of the horizontal conveyor 1, buffers 16 are arranged, which are intended to prevent damage to the suction spider mount, which is only outlined here.

Figure 5:
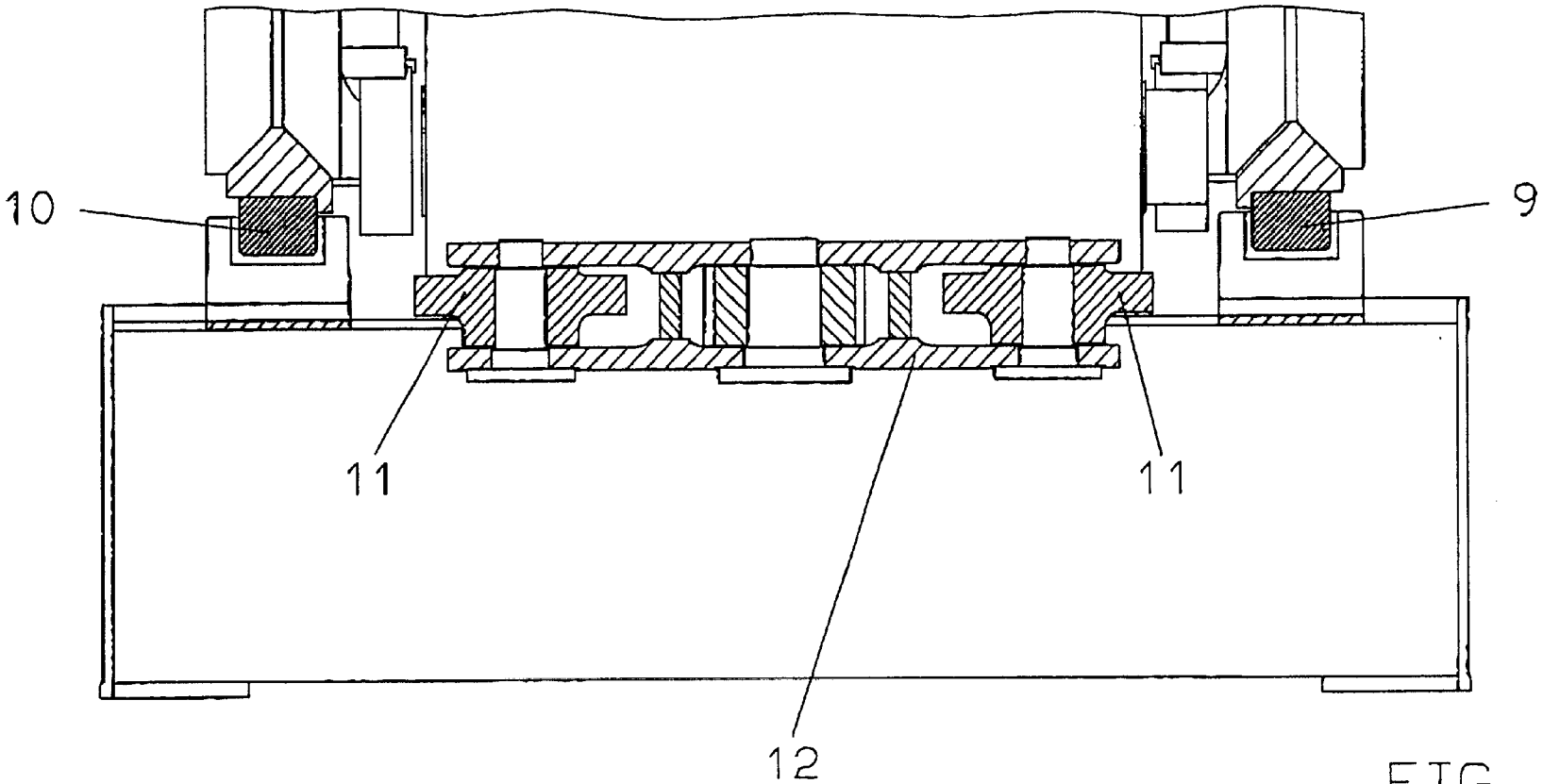
FIG. 5 is a detailed sectional view of the horizontal sled.

FIG. 5 shows details of the horizontal slide 1. The belt locks 11, 11, which are connected with one another by the bridge 12, are arranged between the guides 9, 10 for the horizontal conveyor 1.

Figure 6:
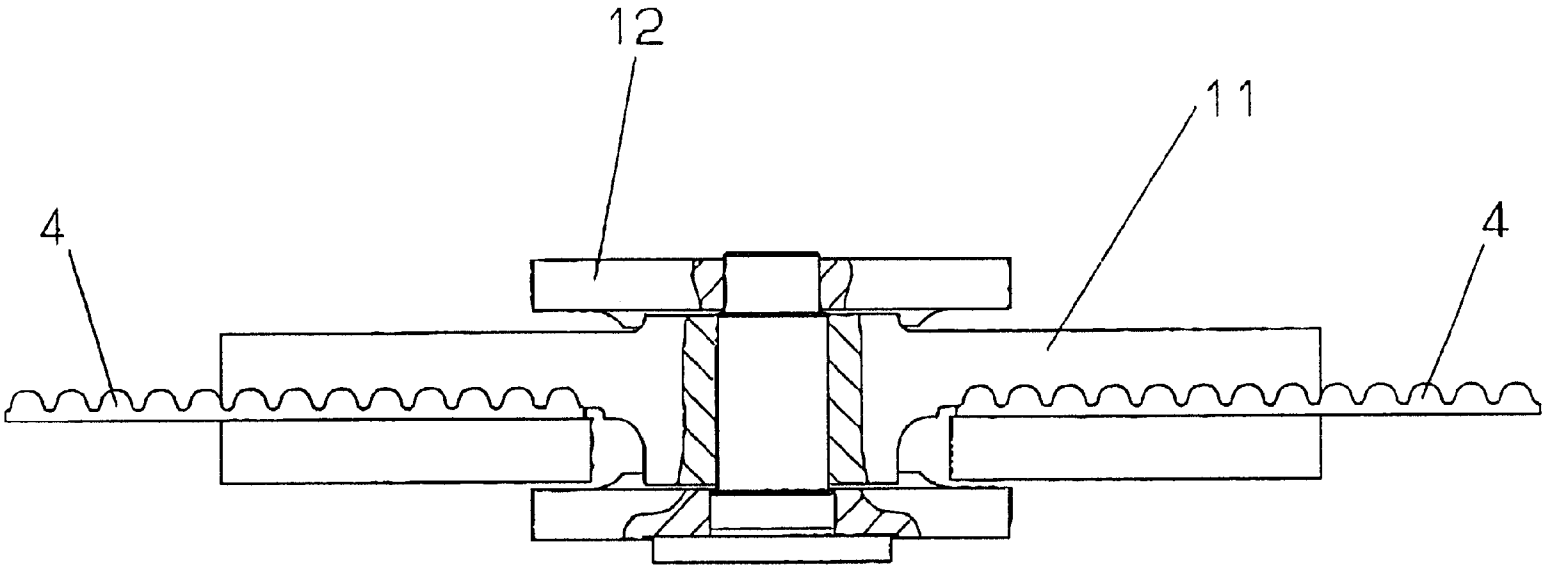
FIG. 6 is a sectional view through the belt lock of FIG. 4.

The belt lock 11 shown in FIG. 6 connects the two ends of belt 4 to form a closed belt. The arrangement of the bridge 12 on the belt lock 11 is also illustrated.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. Apparatus for loading and unloading workpieces, comprising at least one substantially horizontally movable element, at least one substantially vertically movable element and at least one element for receiving workpieces, wherein the at least one substantially horizontally movable element comprises at least one drive unit and has at least two belts that operatively communicate, respectively, with at least one drive unit and the at least one element for receiving workpieces, with the at least two belts configured to be opened and closed by a belt lock.

2. The apparatus as claimed in claim 1, wherein the at least one substantially horizontally movable element has at least one tension roller per belt.

3. The apparatus as claimed in claim 1, wherein the at least two belts are connected by a bridge configured to be deflected to a limited extent.

4. The apparatus as claimed in claim 3, wherein the at least one substantially horizontally movable element has at least one tension roller per belt.

5. The apparatus as claimed in claim 1, wherein the at least one substantially horizontally movable element has at least one guide.

6. The apparatus as claimed in claim 1, wherein the at least one substantially horizontally movable element has at least one buffer to prevent damage in case of malfunction.

7. The apparatus as claimed in claim 1, wherein the at least one substantially vertically movable element has one or more of at least one safety brake, at least one motor at least one spindle and at least one guide.

* * * * *